United States Patent [19]

Golz

[11] 4,029,280

[45] June 14, 1977

[54] STEP LADDER ATTACHMENT

[76] Inventor: Rollin L. Golz, 1708 Peterson Ave., Janesville, Wis. 53545

[22] Filed: Oct. 13, 1976

[21] Appl. No.: 732,079

[52] U.S. Cl. ..... 248/210; 182/129

[51] Int. Cl.[2] ..... E06C 7/14

[58] Field of Search ..... 182/129; 248/210, 211

[56] References Cited

UNITED STATES PATENTS

| | | | |
|---|---|---|---|
| 2,015,378 | 9/1935 | Davis | 182/121 |
| 2,398,617 | 4/1946 | Casey | 248/210 |
| 2,451,020 | 10/1948 | Davis | 248/210 |
| 2,453,355 | 11/1948 | Arnold | 248/210 |
| 2,565,014 | 8/1951 | Beaty | 248/210 |
| 3,396,929 | 8/1968 | Brown | 248/211 |

*Primary Examiner*—Reinaldo P. Machado

[57] ABSTRACT

A pair of screen or storm sash supporting attachments in the form of wooden blocks are releasably secured on the step of a step ladder by U-shaped brackets the forward ends of the attachments being provided with a plurality of spaced sash-holding lugs with anti-slip treads therebetween for holding the lower end of a screen or storm window sash from outward sliding movement.

6 Claims, 4 Drawing Figures

STEP LADDER ATTACHMENT

BACKGROUND OF INVENTION

Various devices have been developed theretofore for supporting screen or storm window sash on a step ladder for convenience in painting, puttying, glazing and the like. U.S. Pat. No. 2,015,378 discloses a screen ladder jack in the form of an elongated bar adapted to be mounted on the step of a ladder and having a T-shaped forward-end portion for supporting the lower end of a sash. U.S. Pat. No. 2,451,020 discloses a bracket formed of twisted wire having a pair of wire hooks at one end for engaging both the step of a step ladder and its side rail — and an upstanding wire loop at its forward end for holding the bottom edge of a sash; and U.S. Pat. No. 2,398,617 discloses ladder attachments in the form of brackets pivotally secured at their inner ends to the rails of the ladder and formed with serrated edges at their forward ends for supporting the bottom edge of a screen or storm sash.

SUMMARY OF INVENTION

The instant invention relates to improved ladder attachments for supporting a screen, storm window or the like on a step ladder so as to facilitate painting ore repairing — the ladder attachment of the instant invention being constructed of relatively rigid light weight low cost materials and designed to be readily attached to and removed from the step of a step ladder, and to provide non-slip support for screen or storm window sash of different dimensions.

PREFERRED EMBODIMENT OF INVENTION

Figure 1:
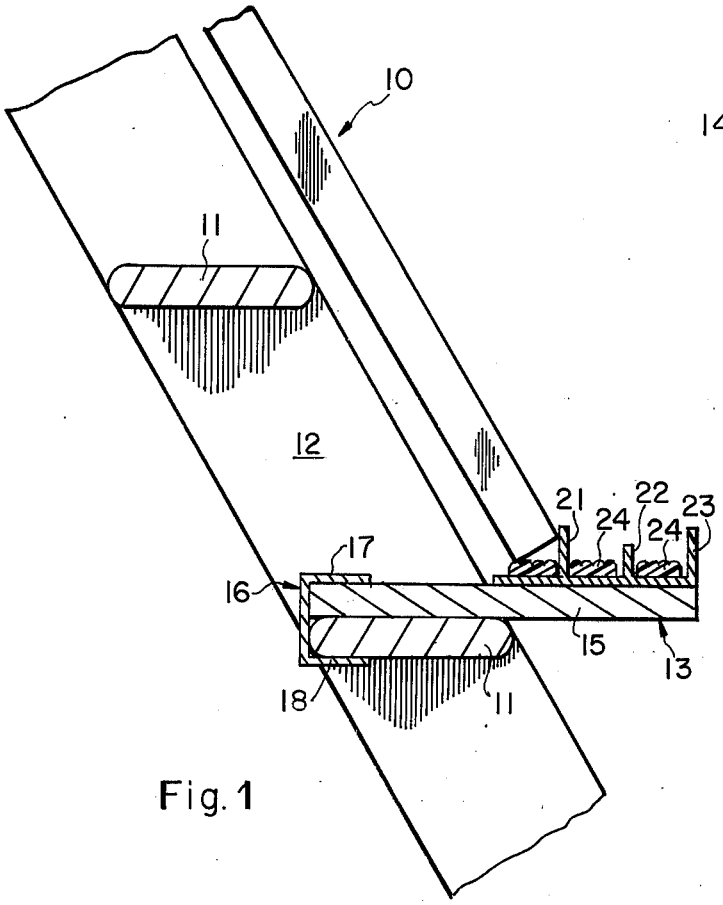
FIG. 1 is a fragmentary vertical section of a wooden step-ladder of conventional construction on one step of which is mounted the screen-supporting attachment of this invention.

Referring to the drawings wherein like numerals of reference designate corresponding parts, the numeral 10 designates, generally, a wooden step ladder of conventional construction having wooden steps 11 secured to side members 12—12.

Figure 2:
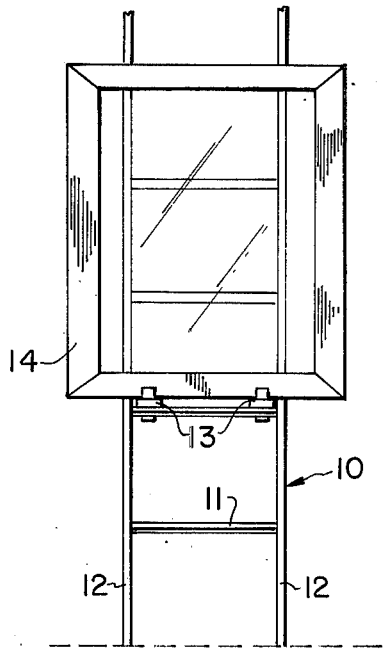
FIG. 2 is a front elevation of a conventional wooden step ladder having a pair of attachments of this invention mounted on a step thereof and supporting a screen.

The screen or storm sash supporting attachments of this invention are indicated generally at 13 and adapted to be removably mounted on a step 11 of the step ladder to facilitate painting or repairing screen or storm sash. To this end two attachments 13 are used one on each side of a step 11 of the step ladder, see FIG. 2, for supporting sash 14. Persuant to the objects of this invention each attachment 13 comprises essentially a substantially rectangular solid wooden block 15 of suitable dimensions to provide strength and rigidity as well as optimum support for the lower end of a screen or storm sash 13. By way of illustration only and not limiting of the invention the thickness of each wooden block 15 may correspond substantially to the thickness of a step 11 of the step ladder while the length of each block 15 may be approximately twice the width of a step 11 such that the forward end of each block 15 will extend forward sufficiently far to insure optimum engle of repose for the screen or storm sash when mounted on the ladder attachments 13.

Figure 4:
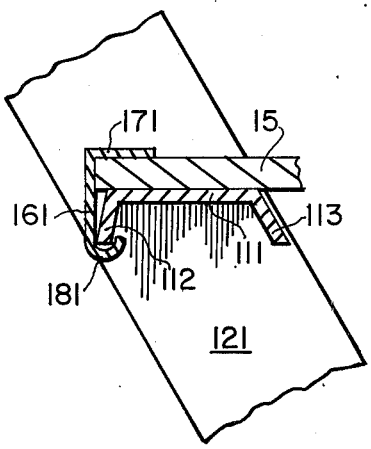
FIG. 4 is a modification of the attachment of FIG. 1–3 adapted for use on a step ladder having metal steps.

Each wooden block 15 is adpated to be releasably mounted on a step 11 of a step ladder by a U-shaped clamp, indicated generally at 16, the upper reach 17 of which overlies and is secured permanently to the rear end of the block 15. The lower reach 18 of the clamp is constructed so as to slidingly engage the rear edge of the step 11. In the form shown in FIG. 1 wherein the block 15 is mounted on the step of a wooden step ladder the lower reach 18 of the bracket is constructed so as to engage against the underside of the wooden step 11; whereas in the modification of FIG. 4, in which the step 111 of the step ladder is metal and formed with depending edges 112 and 113 the clamp is modified as shown at 161, to have a lower reach 181 which is constructed so as to releasably engage over the depending edge 112 of the metal step 111.

In accordance with either construction the clamp 16 or 161, as the case may be, permits the wooden block 15 to be releasably mounted on either the wooden step or the metal step of a step ladder.

Figure 3:
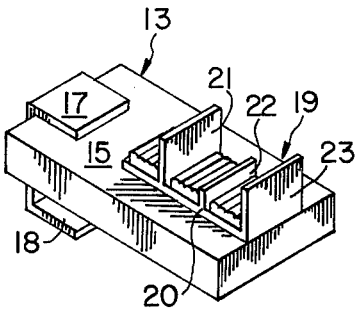
FIG. 3 is a perspective view of one of the supporting attachments of this invention.

Turning now to FIG. 1 and 3 there is shown, in detail, the screen or storm sash holding means 19 of the wooden blocks 15. Each holding means 19 comprises a base plate 20 fixedly secured to the top side of the block 15 adjacent the forward end thereof; and provided with a plurality of integral upstanding lugs, indicated at 21, 22 and 23 respectively, arranged in spaced relationship longitudinally of said base plate 20 — each lug being a substantially rectangular plate positioned transversely of the longitudinal axis of said base plate 20. The lugs are designed to hold the bottom edge of a screen or storm sash against outward sliding movement when mounted on the supporting blocks 15. Moreover the lugs are designed to accommodate screen or storm sash of different sizes at optimum angles of repose for painting or repairing; and to these ends the lugs are spaced apart as aforesaid and of different heights. Thus, as illustrated, the inner and outer lugs 21 and 23 are of substantially the same height and higher than the intermediate lug 22. Further, suitable anti-slip treads 24 are provided between respective pairs of lugs to further insure against inadvertant slipping while painting or repairing sash. Thus the ladder attachments of this invention comprise relatively inexpensive wooden blocks having relatively simple clamping means by which the blocks may be readily mounted on and removed from the step of a step ladder — and in addition are formed with sash-holding lugs suitably designed to accommodate sash of different dimensions at optimum angles of repose for performing various operations on screen or storm sash — together with ant-slip treads to further hold the sash against outward or endwise sliding movement.

The invention may be carried out in other specific ways than those herein set forth without departing from the spirit and essential characteristics of the invention and the present embodiment is therefore to be considered in all respects as illustrative and not restrictive, and all changes coming within the meaning and equivalency range of the appended claims are intended to be embraced therein.

I claim:

1. A pair of attachments adapted to be detachably mounted at opposite sides respectively of a step of a step ladder for supporting screen or storm sash each attachment comprising: a substantially rectangular wooden block the length of which is greater than the width of the step of said step ladder such that when mounted on said step the forward end of said block extends beyond the front edge of said step, a substantially U-shaped sheet metal clamp constructed and arranged to be fixedly secured at its upper reach to the rear end of said block, the lower reach of said clamp arranged to releasably engaged the rear edge of said step, and sash holding means constructed and arranged to be permanently secured to the top of said block adjacent the forward end thereof said sash holding means comprising a metal base-plate extending longitudinally of said block, said base-plate having a plurality of upstanding lugs arranged in spaced relationship longitudinally thereof, and anti-slip material mounted on said base-plate between each pair of lugs.

2. A pair of attachments adapted to be detachably mounted on the step of a step ladder according to claim 1 wherein said upstanding lugs are of different heights.

3. A pair of attachments adapted to be detachably mounted on the step of a step ladder according to claim 2 wherein said upstanding lugs comprise substantially rectangular metal plates arranged transversely of said base-plate.

4. A pair of attachments adapted to be detachably mounted on the step of a step ladder according to claim 2 wherein said anti-slip material comprises a corrugated rubber tread.

5. A pair of attachments adapted to be detachably mounted on the step of a step ladder according to claim 2 wherein the lower reach of said clamp is constructed and arranged to releasably engage the underside of the said step adjacent the rear edge thereof.

6. A pair of attachments adapted to be detachably mounted on the step of a step ladder according to claim 2 wherein the lower reach of said clamp is constructed and arranged to releasably engage the depending rear edge of said step.

* * * * *